US006983877B2

(12) United States Patent
Ko

(10) Patent No.: US 6,983,877 B2
(45) Date of Patent: Jan. 10, 2006

(54) AUTOMATIC HOLE PUNCH

(76) Inventor: Joseph Y. Ko, 12 Morning Dove, Laguna Niguel, CA (US) 92677

( * ) Notice: Subject to any disclaimer, the term of this patent is extended or adjusted under 35 U.S.C. 154(b) by 7 days.

(21) Appl. No.: 10/353,260

(22) Filed: Jan. 28, 2003

(65) Prior Publication Data

US 2003/0160094 A1 Aug. 28, 2003

Related U.S. Application Data

(60) Provisional application No. 60/352,628, filed on Jan. 28, 2002.

(51) Int. Cl.
*B26F 1/04* (2006.01)

(52) U.S. Cl. ..... 234/102; 83/687; 83/549; 83/628; 83/468.7

(58) Field of Classification Search ..... 234/98, 234/102, 103; 83/549, 687, 628, 691, 468.7, 83/446; 270/248, 253, 254, 255
See application file for complete search history.

(56) References Cited

U.S. PATENT DOCUMENTS

| | | | | | |
|---|---|---|---|---|---|
| 1,728,475 | A | | 9/1929 | Cavill | |
| 2,405,150 | A | * | 8/1946 | Kern | 83/618 |
| 3,768,359 | A | | 10/1973 | Koefferlein | |
| 3,987,695 | A | | 10/1976 | Neilsen | |
| 4,036,088 | A | | 7/1977 | Ruskin | |
| 4,421,000 | A | | 12/1983 | Murphy | |
| 4,987,811 | A | | 1/1991 | Ikarashi et al. | |
| 5,588,344 | A | | 12/1996 | Chun | |
| 5,611,254 | A | | 3/1997 | Rall | |
| 5,628,502 | A | | 5/1997 | Amarakoon | |
| 5,797,308 | A | | 8/1998 | Evans et al. | |
| 6,065,379 | A | * | 5/2000 | Shinno et al. | 83/30 |
| 6,269,721 | B1 | | 8/2001 | Tseng | |
| 6,295,908 | B1 | | 10/2001 | Holzhauser et al. | |
| 2002/0000149 | A1 | * | 1/2002 | Miura et al. | 83/628 |
| 2002/0139232 | A1 | * | 10/2002 | Hsu | 83/549 |

FOREIGN PATENT DOCUMENTS

| | | |
|---|---|---|
| WO | WO 02/23152 A1 | 4/2001 |

* cited by examiner

*Primary Examiner*—Kenneth E. Peterson
(74) *Attorney, Agent, or Firm*—Knobbe, Martens, Olson & Bear, LLP

(57) ABSTRACT

An automatic hole punch is disclosed for creating holes in a sheave of sheet material. The automatic hole punch is preferably user-selectable between punching modes, such as two-hole and three-hole modes. A motor is coupled to a camshaft by a gear train. The cam shaft carries a plurality of cams each having an associated punch. As the camshaft rotates, the cams sequentially drive corresponding punches. However, depending on the selected modality, one or more punches may be idle by not being engaged with their respective cams, thus resulting in varying combinations of driven punches resulting in different hole patterns. Finally, a spacer can be inserted into a material receiving slot for adjusting the relative positioning of the material to the punches to properly position the hole pattern along an edge of the material to be punched.

18 Claims, 11 Drawing Sheets

AUTOMATIC HOLE PUNCH

Related Applications

This application claims priority to the U.S. provisional patent application having Ser. No. 60/352,628 and filed on Jan. 28, 2002, the entire contents of which are hereby expressly incorporated by reference.

BACKGROUND OF THE INVENTION

1. Field of the Invention

The present invention relates to an automatic hole punching machine for creating holes in a sheave of papers or other sheet materials.

2. Description of the Related Art

It is typical in an office environment to store collected papers by punching holes through the sheave and inserting appropriate rings or posts through the holes to maintain the collection for storage and subsequent leafing through while maintaining the papers in an orderly stack.

There are various ways and methods in which a sheave of papers may have holes created therethrough. The most common way is through the use of a hole punch, which exerts shear forces on the paper sufficient to punch a hole through one or more sheets. A plurality of holes are typically used to maintain a collection of papers, and thus, the spacing of the holes is an important consideration in light of the storage device, which usually requires a predetermined spacing between the holes.

Most commonly, papers are punched with 2 holes or 3 holes or 4 holes at predetermined spacing along one edge of the paper to correspond with standard binders, folders, or other storage devices. Typically, three holes or four holes are punched down the left side of the pages for storage in what is generally known as a 3-ringed or 4-ringed binder. Also common, two holes are punched along the top edge of the pages for storage in a folder having a pair of rigid or bendable posts.

Many hole-punching devices are manually driven. That is, a user must exert a force on a lever to drive a punch through a sheave of papers. Some devices have been designed to incorporate an electric motor configured to drive one or more punches through the papers, thus alleviating the necessity of the user exerting a manual force to effectuate the punching process.

However, because of the differences in spacing required by commercially available two-ringed, three-ringed, and four-ringed paper storage devices, hole punches must typically be manually reconfigured to appropriately create 2, 3, or 4 holes at the appropriate locations. The reconfiguration required must not only realign the distance between the punches used to create the holes, but must also change the location of the holes relative to an adjacent edge. For example, in one type of three-hole punch, the first hole is spaced approximately 31.7 mm (1¼ inches) from the top edge of the paper, while in a typical two-hole punch, the first hole is spaced about 72.95 mm (2⅞ inches) from the left edge of the paper. Moreover, one type of three-ringed storage device typically spaces the storage rings about 108 mm (4¼ inches) apart, while a two-ringed storage device typically separates the storage rings by about 70 mm (2¾ inches).

Accordingly, in order for a device to punch in two-hole, three-hole, and four-hole configurations, it must not only be able to vary the distance between the holes, but also realign the paper to appropriately locate the holes to coincide with industry standard spacing.

As is most often the case, separate hole punch devices are required for two-hole, three-hole, and four-hole operation. Alternatively, a single device may be manually reconfigured to provide multiple punching modes. However, such reconfiguration is often complex and requires manually adjusting the position of one or more of the punches and may also require manually adjusting the paper location to arrive at a hole pattern that is the correct distance between holes and the proper distance from the edge of the material.

There is thus a need for an automatic hole punch device that provides simple and efficient operation and adjustment between punching modes.

SUMMARY OF THE INVENTION

A hole punching apparatus is provided having one or more punches, a punching die, and a bore formed in the punching die for ridable insertion of the one or more punches. A slot is formed within the punching die to receive a material that is to be punched. One or more cams are coupled to a camshaft and are configured to linearly drive the punches through the bore formed in the punching die. At least one cam is slidable and selectively positionable along the camshaft between a first position and a second position. An electric motor is coupled to the camshaft and rotatably drives the camshaft. A housing is provided to hold the punching, punching die, cams, and electric motor and further includes a material slot formed in its upper surface to align a material to be punched relative to the punches. A modality switch is moveable between a first mode position and a second mode position and is further configured to move the slidable cam between its first position and its second position and is further configured to insert a spacer into the slot when moving into its second position.

The hole punching apparatus may further comprise a reversing switch for reversing of the direction motor upon activation.

Additionally, a cam switch may be provided that has a switch arm rotatably carrying a cam follow that follows the cross section of the camshaft, the camshaft having a portion of its cross section configured with a depression to allow the follower and accompanying switch arm to extend thereby disconnecting the cam switch.

There can be a capacitor connected to the motor for providing electrical current to the motor after the start switch has been disconnected.

A slidable cam assembly can have a first cam and a second cam spaced a fixed distance apart and is slidable along the camshaft between a first position and a second position. A first punch and a second punch are provided such that positioning the slidable cam assembly in the first position locates the first cam adjacent the first punch in a punch driving position and positioning the slidable cam assembly in the second position locates the second cam adjacent the second punch in a punch driving position.

A cam harness may be coupled to one or more punches and configured to translate a withdrawing force from the cams to the punches.

According to another embodiment, a hole punching device comprises a plurality of punches, a motor for driving the punches, and a modality switch moveable between a first position and a second position for selecting between two or more punching modes.

The hole punching device can include a plurality of cams mounted to a camshaft and configured to drive the punches. In one embodiment, each cam has a corresponding punch.

A motor can be coupled to the camshaft by a gear train for transferring the output torque of the motor to the camshaft.

One cam may be slideably disposed on the camshaft such that the cam is selectively engageable with its corresponding punch. Alternatively, the spacing between the punches is variable.

According to one embodiment, the various punching modes result in a plurality of holes that have varying spacing between them. The punching modes can include two-holes, three-hole, or more punching modes.

Optionally, the motor sequentially drive the punches. A reversing switch may also be supplied to reverse the direction of the motor. A cam switch can be added to automatically continue rotation of the camshaft until the camshaft completes a single revolution.

The outer housing can contain a slot for receiving a sheave of material to be punch, wherein the slot is configured to guide the material into an appropriate punching position. In conjunction with the slot, a space may be selectively inserted into the slot to vary the position of the material relative to the punch. The spacer can be moved by the modality switch.

According to yet another embodiment, a hole punching device for creating a plurality of holes in a sheet of material comprises a motor, a plurality of punches configured to create spaced apart holes in the sheet of material, a punch driver is configured to receive the output of the motor and further configured to engage and linearly drive the plurality of punches between a retracted position and an extended position, and a modality switch is configured to vary the distance between the spaced apart holes.

Additionally, a switch can be configured to allow electricity to flow to the motor until the plurality of punches have been driven from a retracted position, to an extended position, and back to a retraced position. Optionally, the modality switch can vary the distance between the spaced apart holes by selectively engaging the punch driver with the plurality of punches.

DETAILED DESCRIPTION OF PREFERRED EMBODIMENTS

In the following description, reference is made to the accompanying drawings which form a part of this written description which show, by way of illustration, specific embodiments in which the invention can be practiced. It is to be understood that other embodiments may be utilized and structural changes may be made without departing from the scope of the present invention. Where possible, the same reference numbers will be used throughout the drawings to refer to the same or like components. Numerous specific details are set forth in order to provide a thorough understanding of the present invention; however, it should be obvious to one skilled in the art that the present invention may be practiced without the specific details or with certain alternative equivalent devices and methods to those described herein. In other instances, well-known methods, procedures, components and devices have not been described in detail so as not to unnecessarily obscure aspects of the present invention.

Figure 1:
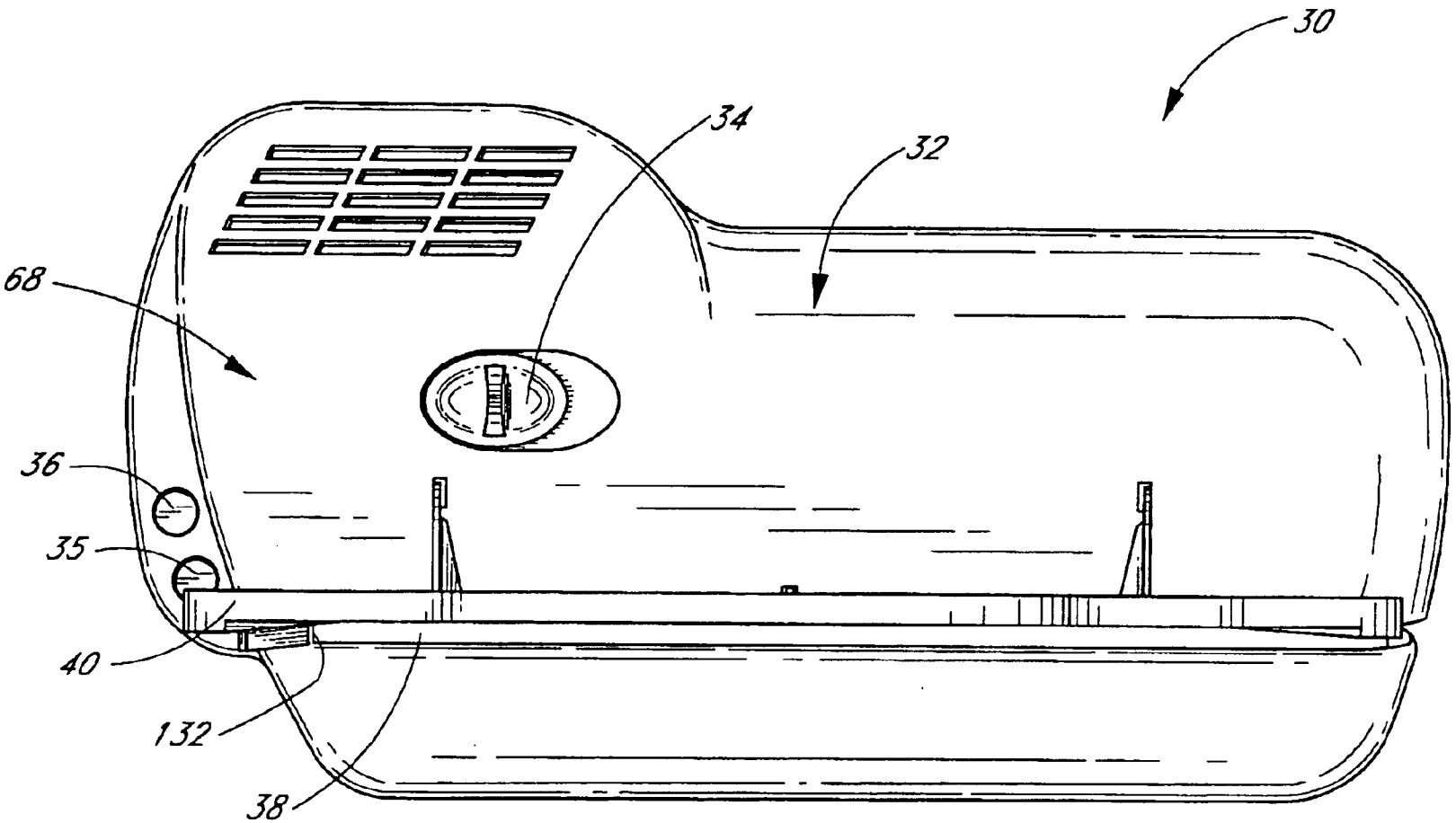
FIG. 1 is a top plan view of one embodiment of an automatic hole punch in accordance with the present invention and showing a user interface.

With reference to FIG. 1, the automatic hole punch 30 has an outer housing comprising an upper housing unit 32 and lower housing unit (not shown). The upper housing unit 32 preferably contains a user interface comprising a modality switch 34 wherein a user can selectively designate a punching mode, such as two-hole, three-hole, or four-hole punching, and at least one user actuatable button to control operating functions, such as for example, to start the punching procedure or to reverse the direction of operation. Appropriately, the embodiment of FIG. 1 contains a start button 35 and a reverse button 36. While the following description refers to an automatic hole punch selectable between two-hole and three-hole punching modalities, it will be apparent to one of ordinary skill in the art that other punching modalities, such as four-hole punching or additional punching modes, are possible by utilizing the aspects taught herein. As used herein, the term "automatic" is a broad term and is used in its ordinary usage and is used herein to mean a device in which the punching force is not manually exerted. Therefore, the illustrated and described embodiments are illustrative, and not limiting, of the claims that follow.

A receiving slot 38 is configured to receive a material to be punched, such as a sheave of papers, and a sheet guide 40 extends upwardly from the upper housing 32 for guiding and supporting a material within the slot 38. The sheet guide 40 extends generally vertically from the top of the upper housing unit 32, and is preferably positioned adjacent to the slot 38. The sheet guide 40 may be tilted at an acute angle with respect to vertical to provide support to a sheave of papers or may be disposed generally vertically, as illustrated.

Figure 2:
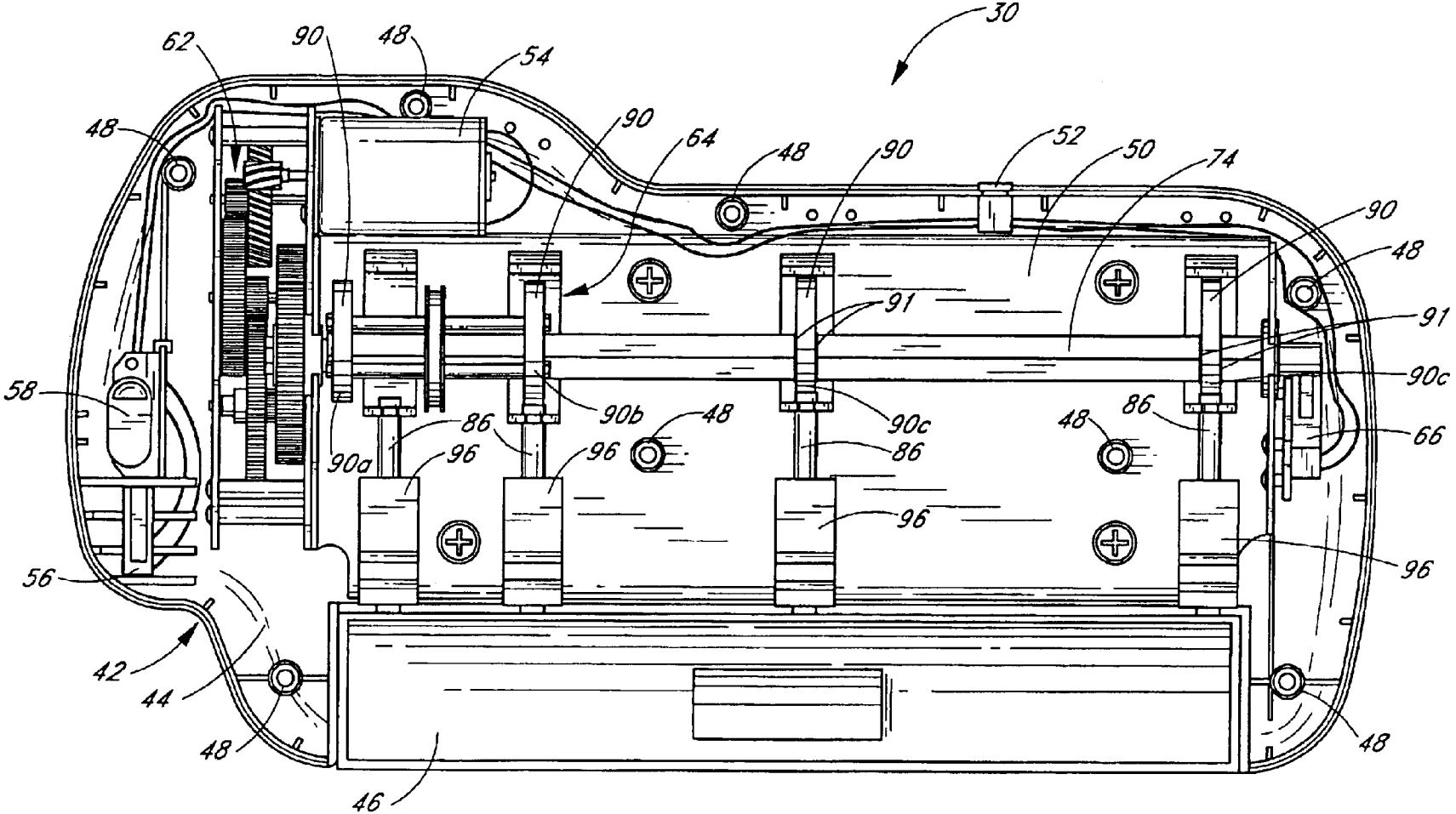
FIG. 2 is a top plan view of the interior components of the automatic hole punch illustrated in FIG. 1.

With reference to FIG. 2, the lower housing unit 42 comprises a tray 44 to substantially hold the interior components and includes a slideably removable drawer 46 for capturing the waste chips produced during the hole punching process for subsequent disposal. The lower housing unit 42 is securely attached to the upper housing 32 in any suitable manner, but in one embodiment, is attached by screws or other fasteners as is known in the art. The lower housing unit 42 preferably includes a plurality of mounting bosses 48 each having a through hole formed therein for receiving a screw or bolt that extends up into corresponding mounting bosses and/or holes formed in the upper housing unit 32 to securely connect the upper and lower housing units 32, 42. The lower housing unit 42 is preferably weighted, either by adding dead weight, or by forming one or more components out of a dense material, to provide the automatic hole punch 30 with a stable base that does not have a tendency to wander during the punching cycle. In a preferred embodiment, a chassis 50 is weighted to provide the desired weight and stability. Optionally, non-slip pads (not shown) may be added to the bottom of the lower housing unit 42 to further discourage slippage.

FIG. 2 illustrates the various systems that combine to provide the advantages of the present automatic hole punch 30. An electrical system has an input receptacle 52 for receiving an electrical plug, and further includes wires for transferring the input electricity to a motor 54 by way of a number of switches. In the illustrated embodiment, the wires form a circuit including a start switch 56, a reversing switch 58, a cam switch 66, and the motor 54. The electrical circuit will be discussed in greater detail below with additional reference to FIG. 3.

A power transfer system 62 transmits the output from the motor 54 to the punch drive system 64, which is responsible for creating the holes in the material. Finally, a user interface system 68 (of FIG. 1) allows a user to select punching modalities and begin the punching cycle.

Figure 3:
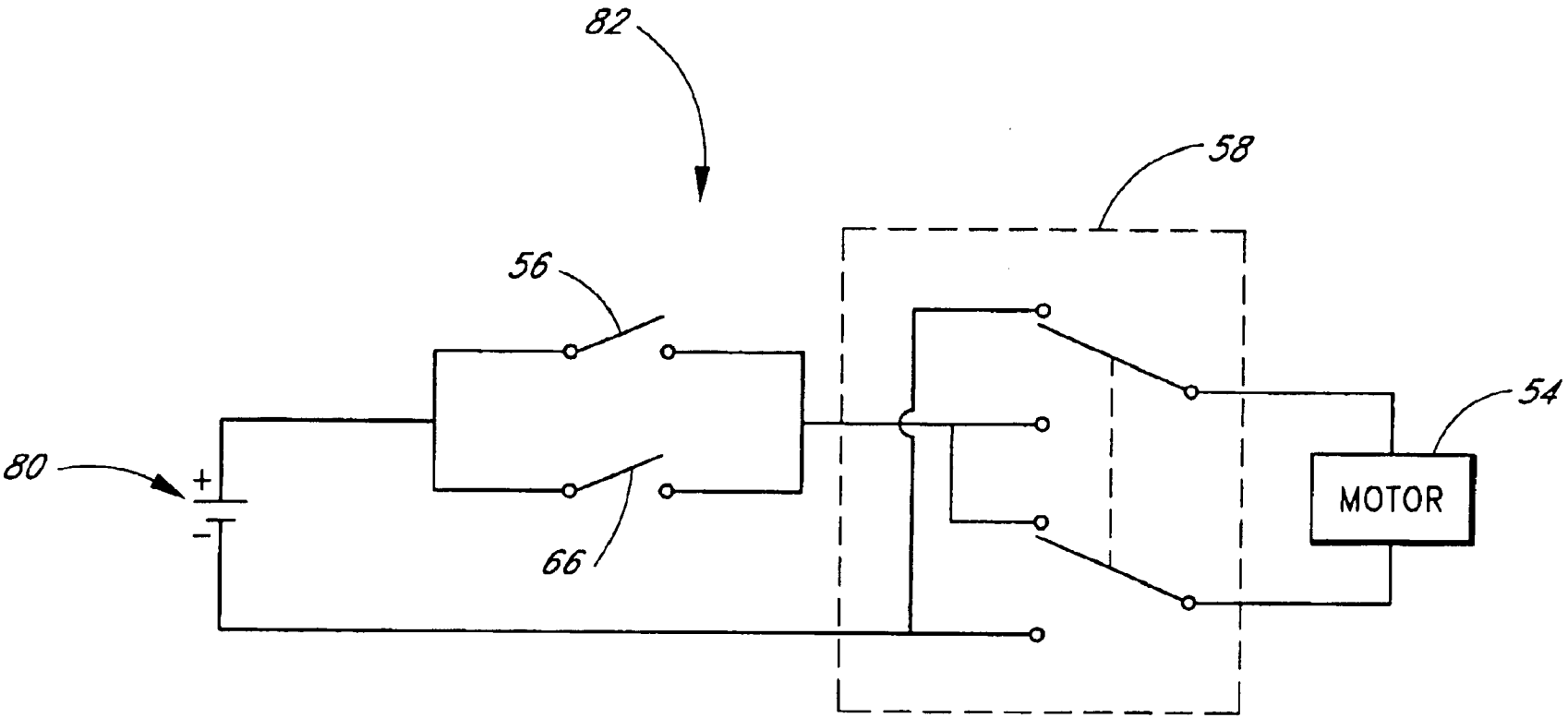
FIG. 3 is a schematic diagram illustrating one embodiment of an electrical circuit for use with the present invention.

The electrical system shown in FIG. 2 is schematically represented in FIG. 3. With reference to those figures, the motor 54 is preferably a DC motor. In other embodiments, the motor can be an AC motor. In the illustrated embodiment utilizing a DC motor, there is preferably an AC to DC converter (not shown) that converts a standard AC current to DC current. Moreover, the AC to DC converter also serves as a voltage step down for reducing the voltage delivered to the automatic hole punch 30. For example, in some areas of the world, a standard AC current is supplied at 110 Volts, while in other areas, a standard AC current may be supplied at 220 Volts. Regardless, an AC to DC converter steps down the voltage and delivers a current to the electrical system at a voltage between about 1 and 20 Volts DC, and more preferably between about 5 and 15 Volts DC, and in one preferred embodiment, at 12 Volts DC.

Figure 5:
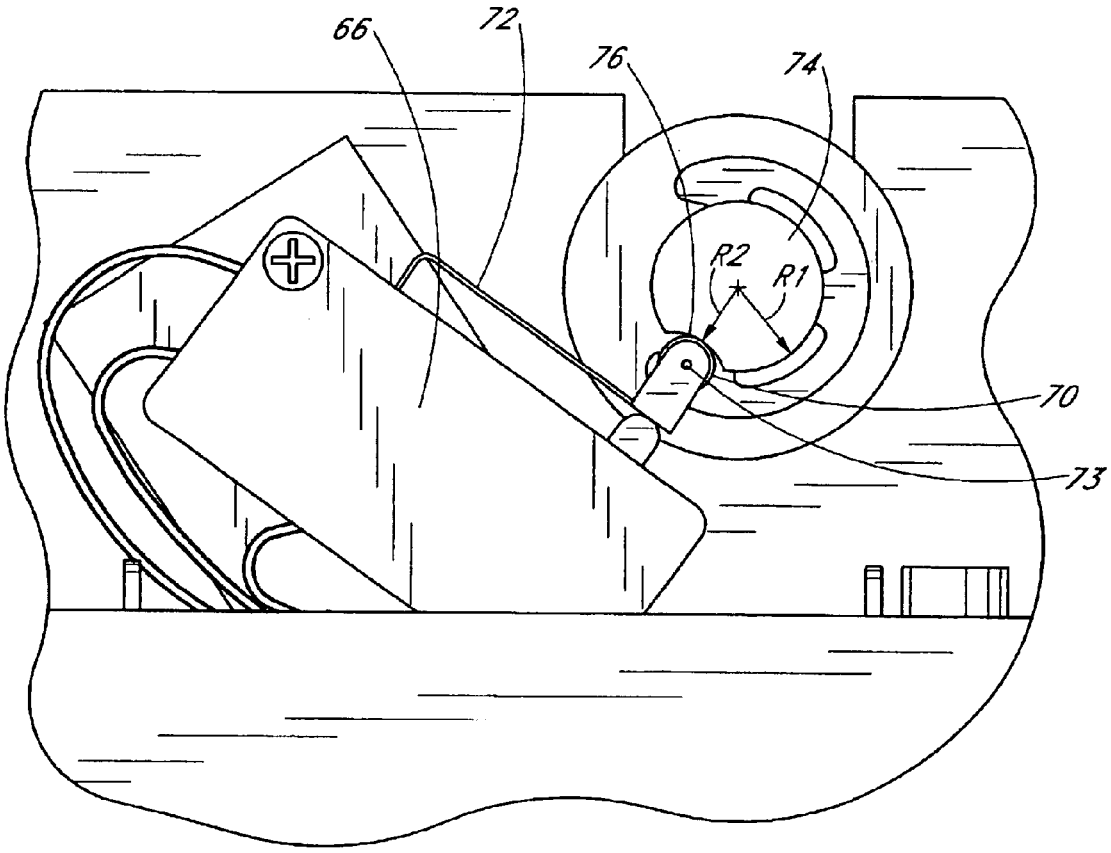
FIG. 5 is a side elevational view illustrating one embodiment of a cam-activated switch for use with the hole punch of the present invention.

The electrical system further comprises a series of switches designed to selectively connect the circuit thereby providing electrical current to the motor 54 to effectuate the punching process. A start switch 56 is configured such that manual depression of the start switch 56 provides a current to the motor 54 which begins rotating. One or more capacitors (not shown) may be provided to deliver a predetermined flow of current to the motor 54 after the start switch 56 is released, as will be described later. To continue motor activation throughout an entire punching cycle, A cam switch 66, better illustrated in FIG. 5, is provided and has a cam follower 70 pin-connected to a switch arm 72 for rotational movement about a pin 73. A camshaft 74 has a substantially circular cross section that provides a generally constant base radius R1, with the exception of a concave fall 76, which provides a second radius R2. In the illustrated embodiment, R2<R1. The purpose of the cam switch 66 will be described later in detail.

With particular reference to FIG. 3, a power source 80, such as an AC/DC converter supplies electricity to the electrical system 82. A start switch 56 is provided for allowing a user to selectively complete the electrical circuit. It can be seen that either actuation of the start switch 56 or actuation of the cam switch 66 will complete the circuit and deliver power to the motor 54.

In one embodiment, one or more capacitors (not shown) may be added to the circuit downstream of the start switch 56 and cam switch 66 to provide a predetermined amount of electricity to the circuit such that, once the start switch 56 is actuated and released, the motor 54 will continue to drive the camshaft 74 as the capacitors discharge. A more detailed explanation for the purpose of the capacitors will be given later.

Figure 4:
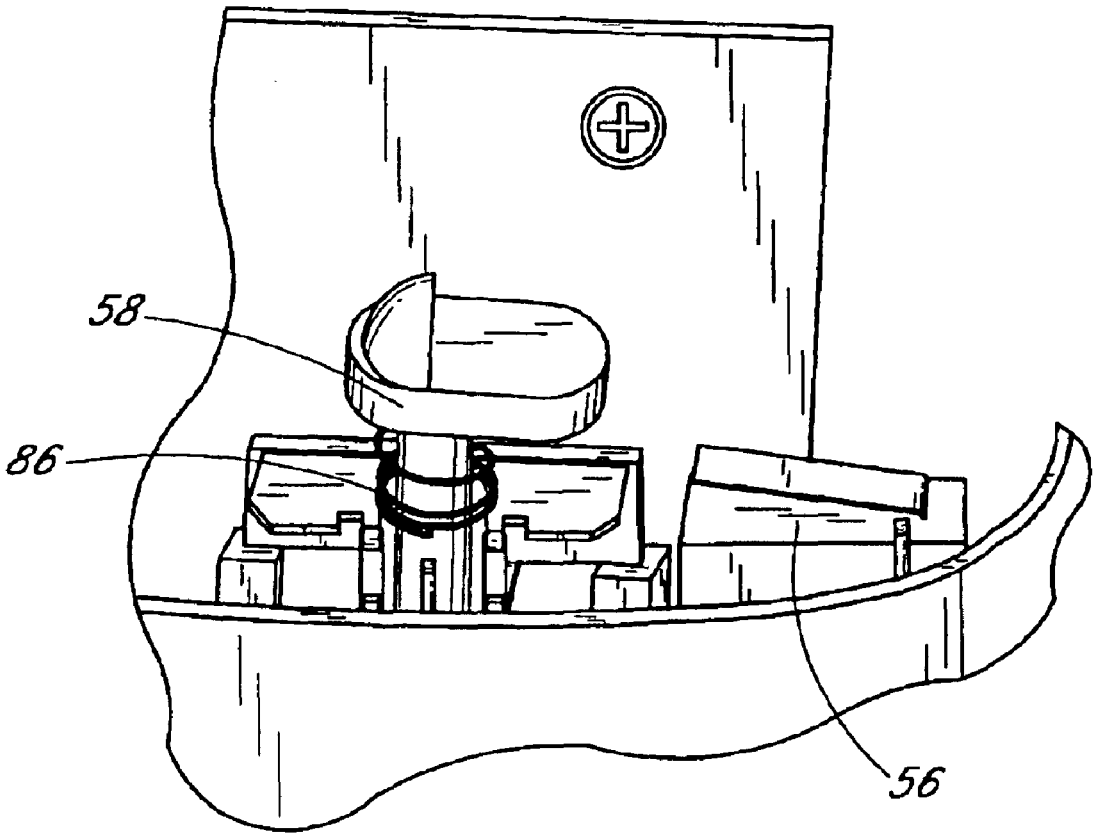
FIG. 4 is an isometric view showing one embodiment of an electrical switch arrangement.

A reversing switch 58 is provided to reverse the direction of the motor. In the illustrated embodiment, the reversing switch 58 is in the form of a single pole dual throw (SPDT) switch. Other embodiments provide alternative switches that provide similar functionality as the described SPDT switch. The reversing switch 58 has two operating modes: forward and reverse. The reversing switch 58 is biased in the forward mode in which the motor turns a desired direction. As shown in FIG. 4, a spring 86 is used to bias the reverse switch 58 upward, in a forward motor 54 operating direction. When the reversing switch 58 is manually actuated to the reverse mode by depressing the reversing switch 58, the electrical current path flowing through the motor 54 is reversed, thus causing the motor 54 to turn in an opposite direction. It is irrelevant whether the motor 54 turns clockwise or counter-clockwise in the forward direction, as long as the reverse direction is opposite to the forward direction of the motor 54.

The switches 56, 58 66 may be secured to the chassis 50 or the lower housing unit 42 by any suitable method. In one preferred embodiment, the start switch 56 and reversing switch 58 are affixed to the lower housing unit 42 by adhesives, while the cam switch 66 is secured to the chassis 50 by screws.

Figure 6:
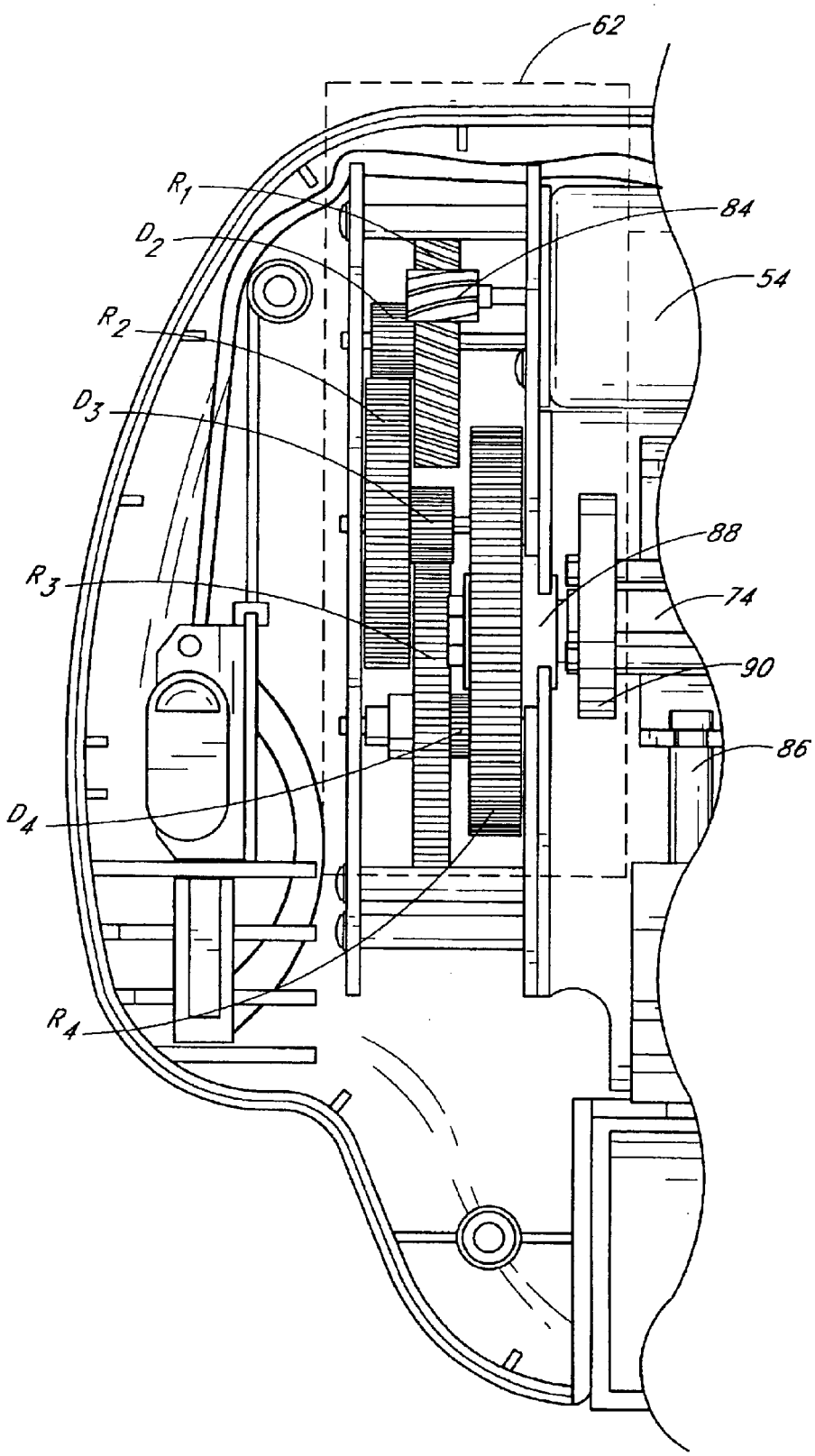
FIG. 6 is a top plan view illustrating one embodiment of a power transfer system for converting the motor output torque to a punching force of the automatic hole punch of the present invention.

With general reference to FIG. 2 and particular reference to FIG. 6, the power transfer system 62 includes a motor 54 which has an output gear 84 coupled to a gear train for transmitting the motor torque through a series of gears to a camshaft 74 which in turn drives one or more punches 86. The gear train comprises a plurality of transfer gears each on a parallel axis. The gear axes are preferably parallel for simplification in operation and manufacture; however, special gears may be employed where the gear shafts are non-parallel. The gear train functions to transfer the angular velocity of the motor's output gear 84 into torque for driving the punches 86. The gears may be of any suitable configuration, and in one embodiment, a combination of helical and spur gears are used. It should be obvious to one of ordinary skill in the art that spur, helical, double helical, stepped, and herringbone gears can be used on parallel shafts as long as the meshing gears share a common diametral pitch.

Moreover, the gear teeth profile may be any suitable shape, such as, for example, cycloidal or involute. In the preferred embodiment, an involute profile is preferable because of its low manufacturing cost and the center distance between a pair of involute gears can be varied without changing the velocity ratios, and therefore, close tolerances between shaft locations are not required.

As illustrated in FIG. 6, the motor output gear 84 is a helical gear that meshes with driven gear R1. Driven gear R1 shares a shaft with pinion drive gear D2, which meshes with driven gear R2. Preferably the radii of the gears (and the relative tooth number) is such that D2<R2, and therefore, as the relative angular velocity is reduced between D2 and R2, the transferred torque is increased.

Similarly, driven gear R2 shares a gear shaft with pinion drive gear D3, which in turn drives driven gear R3. Driven gear R3 shares a gear shaft with pinion drive gear D4, which in turn drives driven gear R4, which is coupled to the camshaft 74 and rotates therewith. In other embodiments, the gear train may comprise anywhere between 2 and 20 gear pairs. Regardless of the number of gear pairs, the final driven gear is coupled to a camshaft 74 which carries a plurality of cams 90 thereon. The power transfer system 62 thus accepts the input of the motor 54 and delivers the output of reduced angular velocity and increased torque to the punch drive system 64.

Figure 7:
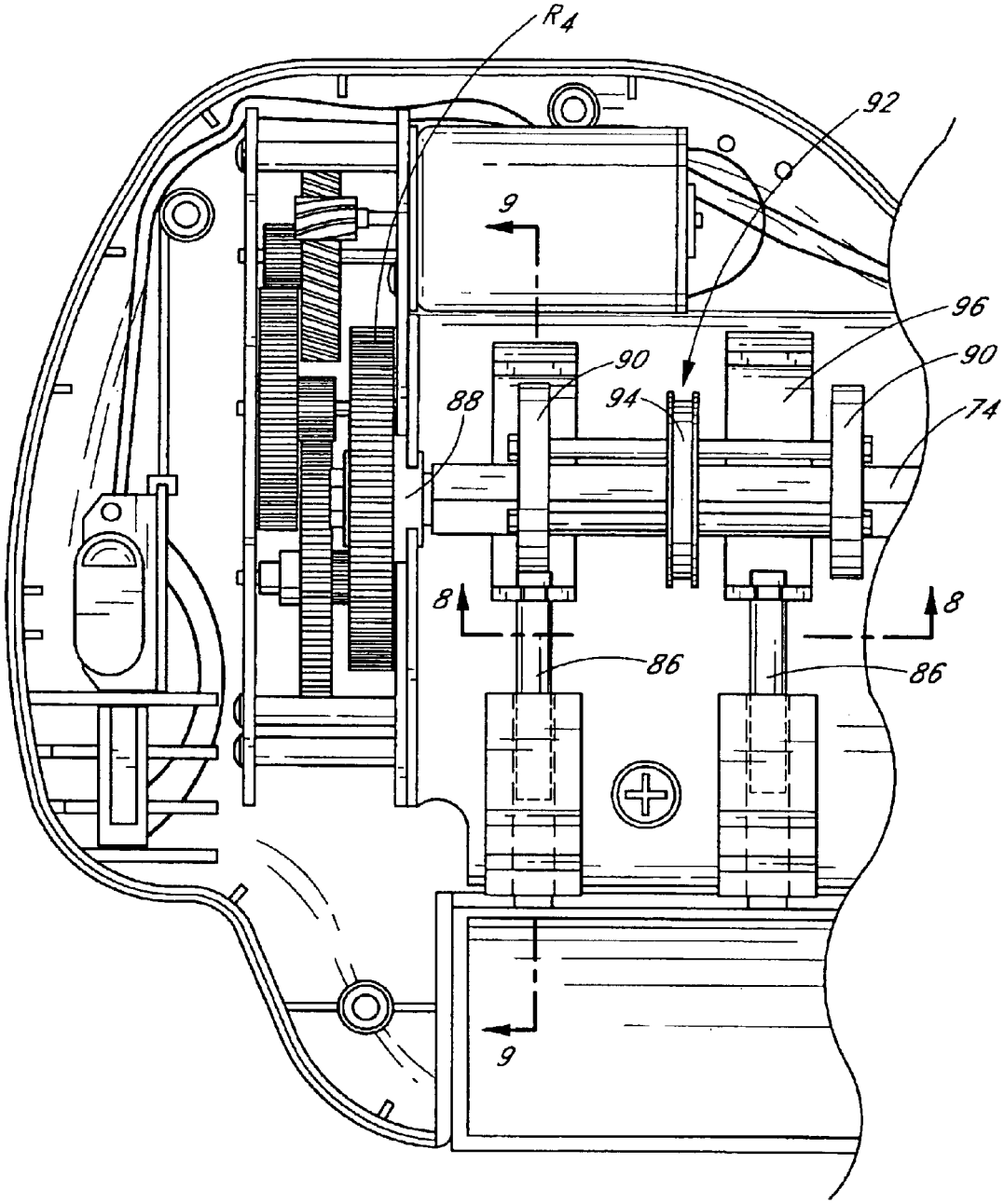
FIG. 7 is a top plan view illustrating the punching system including a selectively positionable cam assembly.

As best shown in FIG. 7, the punch drive system includes the camshaft 74, a plurality of cams 90, and a slidable cam assembly 92. In the illustrated embodiment, the camshaft 74 is journaled along at least two points of its length, such as by bearings or bushings 88. Furthermore, the camshaft 74 is preferably shaped to have a polygonal cross section rather than a circular cross section such that the final driven gear R4 and any cams 90 mounted thereon will not have a tendency to slip about the camshaft 74. In the illustrated embodiment, the camshaft 74 is hexagonal in cross-section and each cam 90 has a correspondingly shaped mounting cutout for securely mounting to the camshaft 74. In other embodiments, the camshaft 74 may be of any suitable cross section and the driven gear R4 and any cams 90 may be secured in any suitable manner. The camshaft 74 carries two types of cams, slidable cams 90*a*, 90*b*, and static cams 90*c* (of FIG. 2). When this written description describes properties generic to all the cams, the reference numeral 90 will be used to refer to all the cams generally. However, when referring to specific cams, they will either be described as slidable cams 90*a*, 90*b*, or static cams 90*c*. The static cams 90*c* are held in place along the camshaft 74 by appropriate clips 91 (FIG. 2) attached to the camshaft 74 on either side of the cam 90*c*. The clips 91 may be any suitable type of clips, such as E-clips that securely connect to the camshaft 74 to prevent slidable displacement of the cams 90*c* along the camshaft 74. Other embodiments allow the static cams 90*c* to be welded or otherwise affixed to the camshaft. Thus, the static cams 90*c* are constrained from slidable movement along the camshaft 74.

Figure 8:
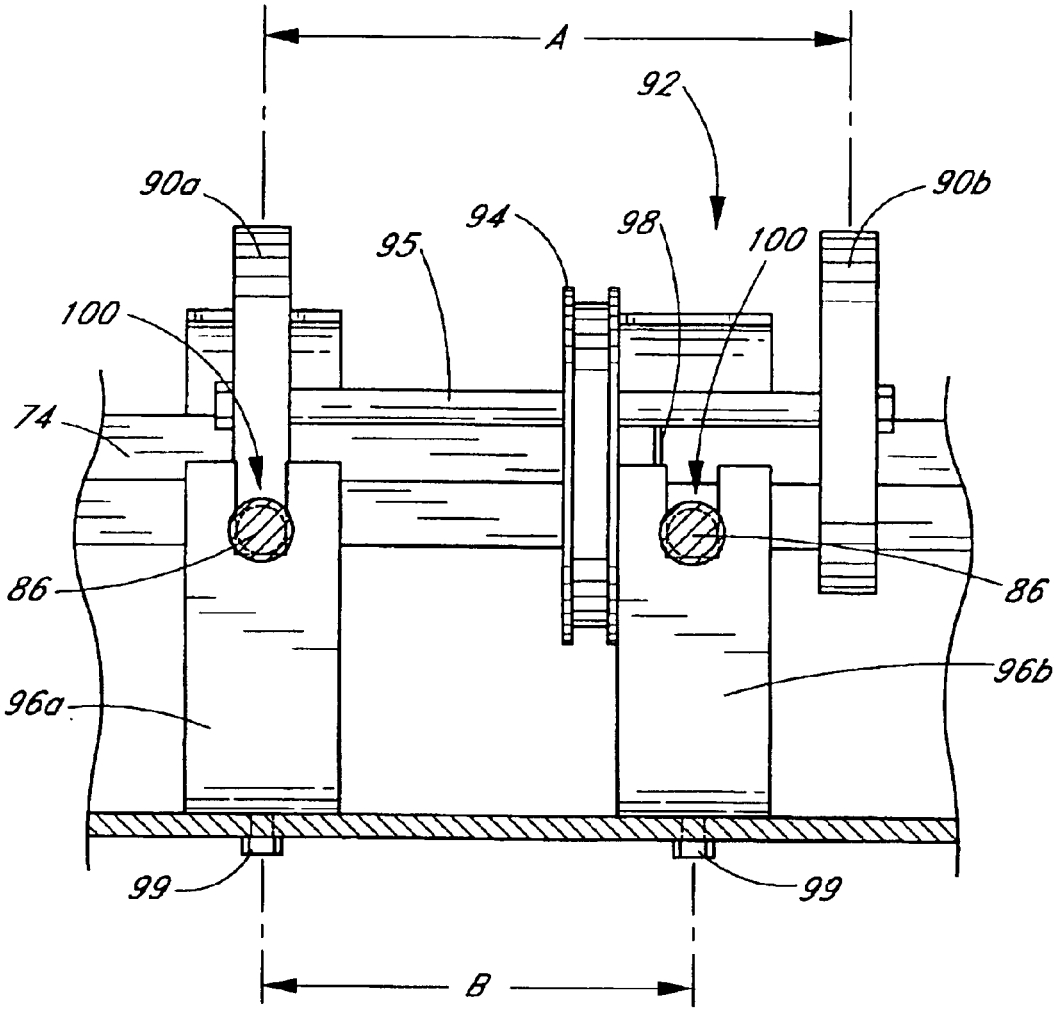
FIG. 8 is a cross sectional view of the punch system taken along line 8—8 of FIG. 7.

With additional reference to FIG. 8, the slidable cam assembly 92 is shown in further detail. The slidable cam assembly 92 comprises a pair of slidable cams 90*a*, 90*b* coupled together by an actuator ring 94 and are spaced by one or more struts 95. The struts 95 are preferably rigid and constrain the slidable cam 90*a*, 90*b* spacing A. A pair of cam harnesses 96*a*, 96*b* cooperate with the pair of slidable cams 90*a*, 90*b* respectively; however, the spacing B of the cam harnesses 96 is not equidistant to the slidable cam spacing A. As such, only one slidable cam 90*a*, 90*b* aligns with its respective cam harness 96*a*, 96*b* at a given time. In the illustrated configuration, slidable cam 90*a* aligns with its respective cam harness 96*a*, while slidable cam 90*b* is out of alignment with its respective cam harness 90*b*.

The slidable cam assembly 92 is able to selectively slide along the camshaft 74. Its travel limit to the right is limited by the actuator ring 94 interfering with cam harness 96*b*, and is limited to the left by an appropriate clip 98 attached to the camshaft 74 that interferes with further travel of the slidable cam 90*b*. Thus, the slidable cam assembly 92 is moveable between two positions: one in which slidable cam 90*a* aligns with its respective cam harness 96*a*, and the other in which slidable cam 90*b* aligns with its respective cam harness 96*b*. The action of the slidable cam assembly 92 will be described later in further detail.

Figure 9A:
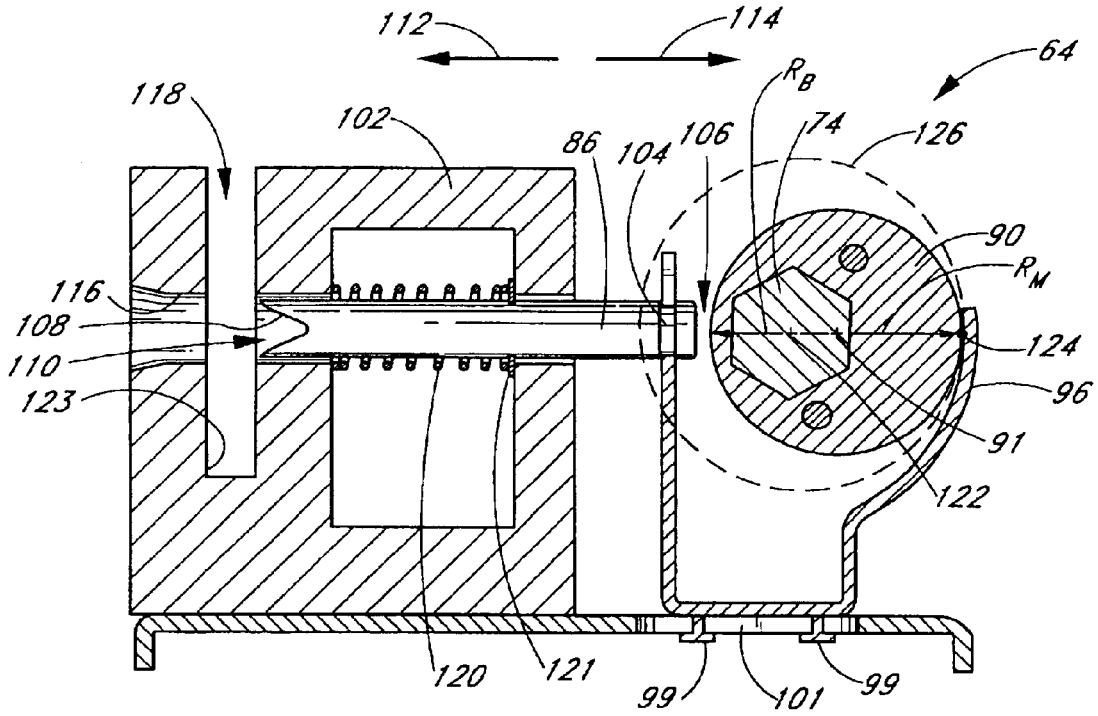
FIG. 9*a* is a cross-sectional view of the punching system taken along line 9—9 of FIG. 7.

With reference to FIGS. 8 and 9*a*, each punch harness 96 is slideably mounted to the chassis 50. In the illustrated embodiment, each cam harness 96 has a pair of bolts 99 extending through a slot 101 formed in the chassis 50. The slot 101 is formed parallel to the punch 86, and thus allows the cam harness 96 to slide in both a punching direction 112 and a retracting direction 114. The benefits of the harness 96 will be disclosed later in further detail.

Figure 9B:
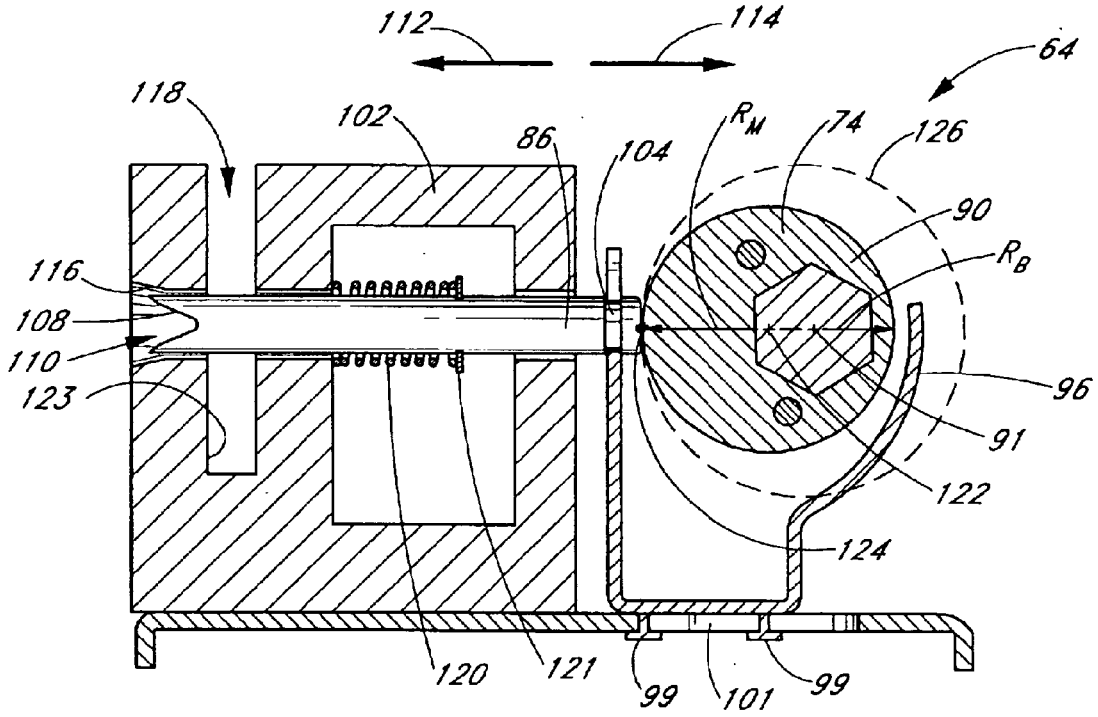
FIG. 9*b* is a cross-sectional view of the punching system taken along line 9—9 of FIG. 7 showing the travel limit of the punching system.

With particular reference to the embodiment of FIGS. 9*a* and 9*b*, it is illustrated how the cam harnesses 96 couple the punch drive system 64 to the punch system. The punch system is comprised of a plurality of punches 86 and a plurality of punch dies 102. Each punch harness 96 is coupled to a corresponding punch 86 by any suitable manner. In the illustrated embodiments of FIGS. 7–9, each punch harness 96 includes a cutout 100 into which a portion of each punch 86 is receivable. FIG. 9*a* illustrates one embodiment of a punch system in which a punch 86 is substantially an elongate rod having an annular groove 104 toward its back end 106 and a cutting notch 108 formed in its cutting end 110.

The annular groove 104 provides an area of decreased diameter which is configured to fit within the cutout 100 formed in each cam harness 96. Accordingly, each cam harness 96 is able to securely hold its respective punch 86 and transmit an actuating force to the punch 86 in both a punching direction 112 and a retracting direction 114.

The punching dies 102 of the punching system are each configured with a bore 116 formed therethrough configured to receive a punch 86. Each punching die 102 is preferably made of a rigid material, such as steel, and includes a material slot 118 formed therein for receiving at least one sheet of material to be punched. In one embodiment, as illustrated, the material slot 118 extends substantially parallel to the camshaft 74, and is generally perpendicular to the plurality of punches. As described in relation to the material guide 40, the material guide 40 and material slot 118 may be oriented at any angle to provide proper guidance and orientation of the material relative to the punches 86.

The punching dies 102 additionally contain a coil spring 120 that is coaxial with the punch 86. An E-clip 121, or other suitable device, is securely attached to the punch 86 at an appropriate location such that as the punch 86 slides through the punching die 102, the clip 121 contacts the spring 120 and compresses it. Upon compression, the spring 121 provides a restoring force to withdraw the punch 86 in a retracting direction 114. Other types of structure to bias the punch 86 in a retracting direction are possible and are within the scope of the present automatic hole punch 30.

The cutting end 110 of the punch is preferably configured to provide a large shear force on the material placed within the material slot 118. In general, punches may be either of the boring type, in which a blade augers through a material, or the shearing type. The illustrated embodiment uses a shearing type in which shear forces are imparted on the material to be punched by the cross section of the punch 86 as it moves through the bore 116 in the punching die 102. The material is compressed against a distal wall 123 of the material slot 118 where the shear forces cause the material to breach as the punch 86 continues through the bore 116 in the distal wall 123 of the material slot 118.

Preferably, the cutting end 110 of the punch 86 is sharpened to increase the shear forces. In the preferred embodiment, this is accomplished by forming a substantially V-shaped or U-shaped notch 108 in the cutting end 110 of the punch 86 such that only a portion of the cutting end 110 initially contacts the material. In other embodiments, the cutting end 110 of the punch 86 can be sharpened by creating a semi-hollow tip in which the periphery of the tip comprises a thin-walled tube having sharpened edges. By minimizing the punch 86 surface area that contacts the material through any suitable method, the shear forces imparted to the material are greatly increased which overcomes the material's resistance to the punching operation. It should be noted that the disclosed punch 86 is designed to sever a portion of the material, rather than simply puncture it.

With continued reference to FIGS. 9*a* and 9*b*, it can be seen how the cam 90 is not concentric with the camshaft 74. That is, the cam center 91 does not align with the camshaft center 122. Consequently, as the camshaft 74 rotates about its center 122, a point 124 on the cam 90 traces an imaginary circle 126 defined by the radius of the camshaft center 122 to the point 124 on the cam 90. Accordingly, the cam 90 has a base radius $R_B$, and a maximum radius $R_M$. The shape of the cam 90 can thus be described as beginning with the base radius $R_B$, having an involute rise to the maximum radius $R_M$, and then gradually falling to the base radius $R_B$. While this cam shape is examplary of one particular embodiment of a suitable cam 90, other cam shapes are contemplated as being within the scope of the automatic hole punch 30 of the present invention. The illustrated embodiments show that each cam 90 shares a common profile, although distinct profiles could be used.

Therefore, as the cam 90 rotates, at a particular angular orientation, a portion of the cam 90 will contact its respective punch 86 and drive the punch linearly as the cam 90 continues to rotate through its maximum radius $R_M$. Accordingly, the travel limit of the punch 86 is defined by the difference between the maximum cam radius $R_M$ and the minimum cam radius, or base radius $R_B$. The maximum linear travel of the punch 86 in a punching direction 112 is illustrated in FIG. 9*b*. As the cam rotates beyond its maximum radius $R_M$, the restoring force of the spring will cause the punch 86 to withdraw from the material slot 118. However, if the punch 86 is unable to withdraw from the material slot 118 under the restoring force of the spring 120, the cam 86 will contact the cam harness 96 and cause it to withdraw the punch 86 from the material slot 118.

As can be seen in FIG. 9*b*, when the punch 86 reaches its travel limit in a punching direction 112, it fully extends through the material slot 118. However, the punch 86 does not extend beyond the confines of the die 102 to protect a user from the sharpened cutting end 110 of the punch 86.

During operation, as the motor 54 is activated, the torque transfers through the gear train and rotates the camshaft 74 and the attached cams 90. As the cams 90 rotate, they each contact their respective punch 86 and drive each punch 86 linearly through the material slot 118. In order to complete a full punching cycle, the camshaft 74 must make one complete revolution. Therefore, electricity must be supplied to the motor 54 until the camshaft 74 completes one revolution.

Upon activation of the start switch 56, the camshaft 74 begins rotating and the cam follower 70 follows the profile of the camshaft 74. Once the camshaft 74 rotates a predetermined angular distance, the cam follower 70 is no longer in alignment with the concave fall 76. The base radius R1 of the camshaft 74 and the relative position of the cam follower 70 are preselected such that as the cam follower 70 is following the base radius of the camshaft 74, the cam switch 66 is depressed, and thus the cam switch 66 is actuated and a current is delivered to the motor 54. Upon each complete revolution of the camshaft 74, the cam follower 70 tracks into the concave fall 76 thereby allowing the switch arm 72 to be lifted thus disconnecting the cam switch 66, thereby interrupting the electrical connection to the motor 54. Once the electrical circuit to the motor 54 is disconnected, the motor 54 stops turning.

As discussed above, the cam switch 66 is automatically actuated once the motor 54 begins turning the camshaft 74. This allows a user to quickly depress and release the start switch 56, yet the motor continues turning until the camshaft 74 makes one complete revolution and the cam follower 70 rests in the concave fall 76 and the switch becomes disconnected. However, in order to ensure the cam switch 66 is activated following activation of the start switch 56, even if the start switch 56 is quickly depressed and released, one or more capacitors (not shown) may be introduced into the electrical circuit to provide a predetermined amount of electricity to the motor after the start switch 56 has been released. Thus, no matter how quickly the start switch 56 is activated, the motor will turn a sufficient distance to rotate the camshaft 74 to activate the cam switch 66, which maintains the electrical circuit until the camshaft 74 completes one revolution.

While not immediately apparent from the illustrations, in one preferred embodiment the cams 90 are carried by the camshaft such that the cams 90 are out of phase with one another. For example, when the camshaft 74 rotates, each cam 90 drives its associated punch 86 sequentially, rather than simultaneously, thereby delivering the torque created by the motor 54 to each punch separately. This allows each punch 86 to receive the maximum punching force, rather than divide the punching force between a plurality of cams 90 all engaging simultaneously, thereby evening out the load on the motor 54, power transfer system 62, and camshaft 74, and reducing the likelihood of the punches 86 becoming jammed for lack of punching force.

However, should the punches 86 become jammed, a reversing switch 58 causes the electricity to flow through the motor 54 in an opposite direction. FIG. 3 shows a schematic of a single pole dual throw switch that functions to reverse the direction of current flow through the motor 54 upon activation.

The reversing switch 58 allows the motor 54 to withdraw the punches 86 in the event one or more of them become jammed within the material being punched. For example, if a user inserts a sheave of papers that exceeds the automatic hole punches' 30 design capabilities, the punches 86 may get jammed within the material without completing the punching cycle. In this case, a user may depress and hold the reversing switch 58 which causes the motor 54 to reverse direction. Thus, the camshaft 74 also reverses direction which causes the cams 90 to rotate in an opposite direction. Even though one or more punches 86 may be jammed within the material, the cams 90 and camshaft 74 are not directly connected to the punches 86 and are thus free to rotate independently of the punches 86. As the cams 90 rotate, a point 124 on the cams 90 will contact a portion of the cam harness 96 and drive the cam harness 96 and its associated punch in a withdrawing direction 114 thereby dislodging the punches 86 and withdrawing them from the material as shown in FIG. 9*a*. The cam switch 56 also functions in the reverse direction to stop the camshaft 74 rotation when the cam follower 40 rests in the concave fall 76 of the camshaft 74. Thus, the motor 54 reverses its direction long enough to fully withdraw the punches 86 from the material and, absent continued user activation of the start switch 56, will automatically stop when the punches 86 are fully withdrawn from the material.

The modality switch 34 of the user interface allows a user to designate separate punching modes, such as 2-hole or 3-hole punching. The sliding of the modality switch 34 effectuates changes in both the slidable cams 90*a*, 90*b*, and further inserts a spacer 130 into the material slot 38 of the upper housing unit 32. As described above, standardized binders for holding papers typically come in either a 2-hole or 3-hole variety. However, not only must the spacing between holes be different, but the spacing from the material edges must also be different to allow papers to be inserted into the various available binders. Accordingly, the modality switch 34 makes the appropriate adjustments to both the punch drive system 64 and inserts a spacer 130 into the material slot 38 to properly align the material edge depending on the user-selected punching mode.

There are a plurality of cams 90 and punches 86 appropriately located to correspond with the user selectable two-hole and three-hole modes. In the illustrated embodiments of FIGS. 2 and 8, there are four cams 90 and four corresponding punches 86 wherein two punches 86 are utilized for the two-punch mode and three punches 86 are utilized for the three-punch mode. The automatic hole punch 30 is user selectable between two-hole and three-hole punch mode by selectively positioning the modality switch 34 on the upper housing unit 32. A portion of the modality switch 34 is coupled to the pair of slidable cams 90*a*, 90*b* at the actuator ring 94 such that sliding the lever selectively engages or disengages one or the other slidable cams 90*a*, 90*b* from their respective punches 86. The remaining two static cams 90*c* are statically connected to the camshaft such that they always align with their respective punches 86. As described above, only one of the two slidable cams 90*a*, 90*b* is engaged depending on the selected punching mode.

In the two-hole punching mode, one of the slidable cams 90*b* and one of the static cams 90*c* are used to form the appropriately positioned holes in the material. In the 3-hole punching mode, one of the slidable cams 90*a*, and two of the static cams 90*c* are used to create the appropriately positioned holes. When in the 2-hole punching mode, although both static cams 90*c* drive their respective punches 86, the material typically only encounters one punch 86 driven by a static cam 90*c* because the material width is not sufficient to span the distance between the spacer 130 and the furthermost punch 86.

In selecting between punching modes, the slidable cams 90*a*, 90*b* are displaced along the camshaft 74 such that only one or the other slidable cam 90*a*, 90*b* is aligned with its respective punch 86. Therefore, one of the slidable cams 90*a* will engage its respective punch 86 in the three-hole mode, while the other slidable cam 90*b* will engage its respective punch 86 in the two-hole mode. In one embodiment of an Automatic Hole Punch configured for three-hole punching mode, the cams 90 are preferably spaced a fixed distance apart from one another, such as for example, 108 mm (4¼ inches). In the two-hole punching mode, the two active cams are spaced a distance apart from one another, such as for example, 70 mm (2¾ inches). The recited spacing dimensions are illustrative and do not limit the contemplated spacing of the cams or punches.

Figure 10B:
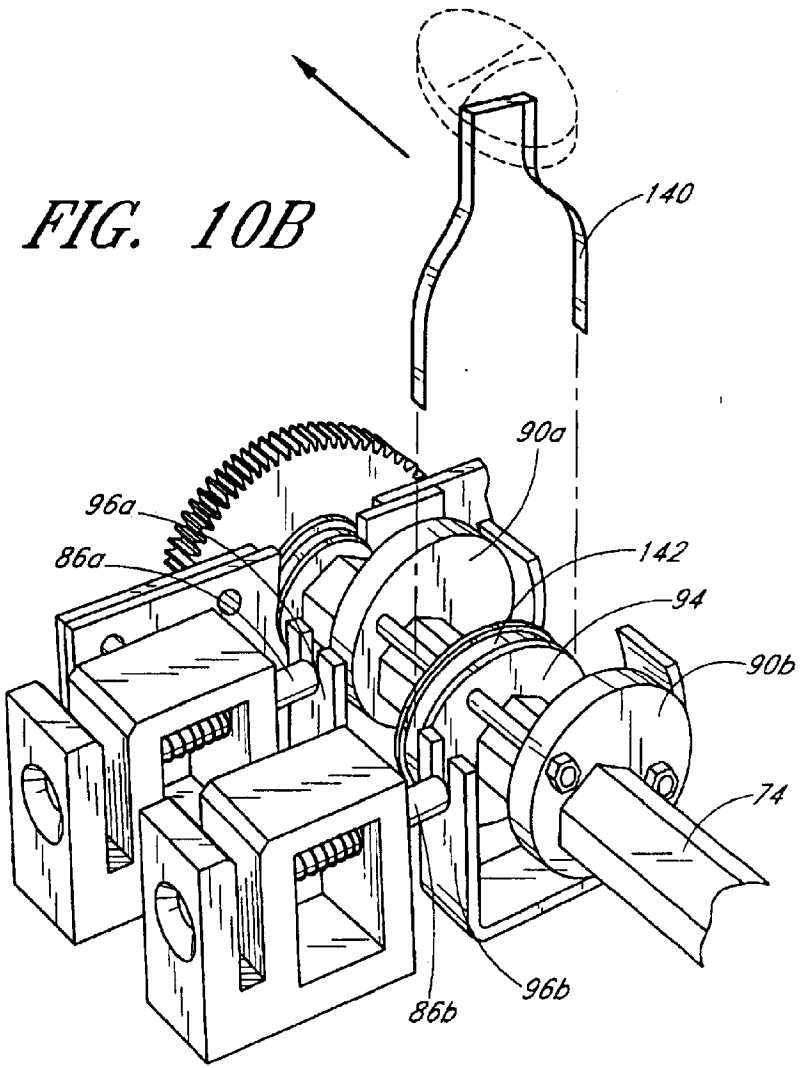
FIG. 10*b* is a partial isometric view of the cam assembly removed from the automatic hole punch showing the actuation of the user interface for creating a second punching modality.
Figure 10A:
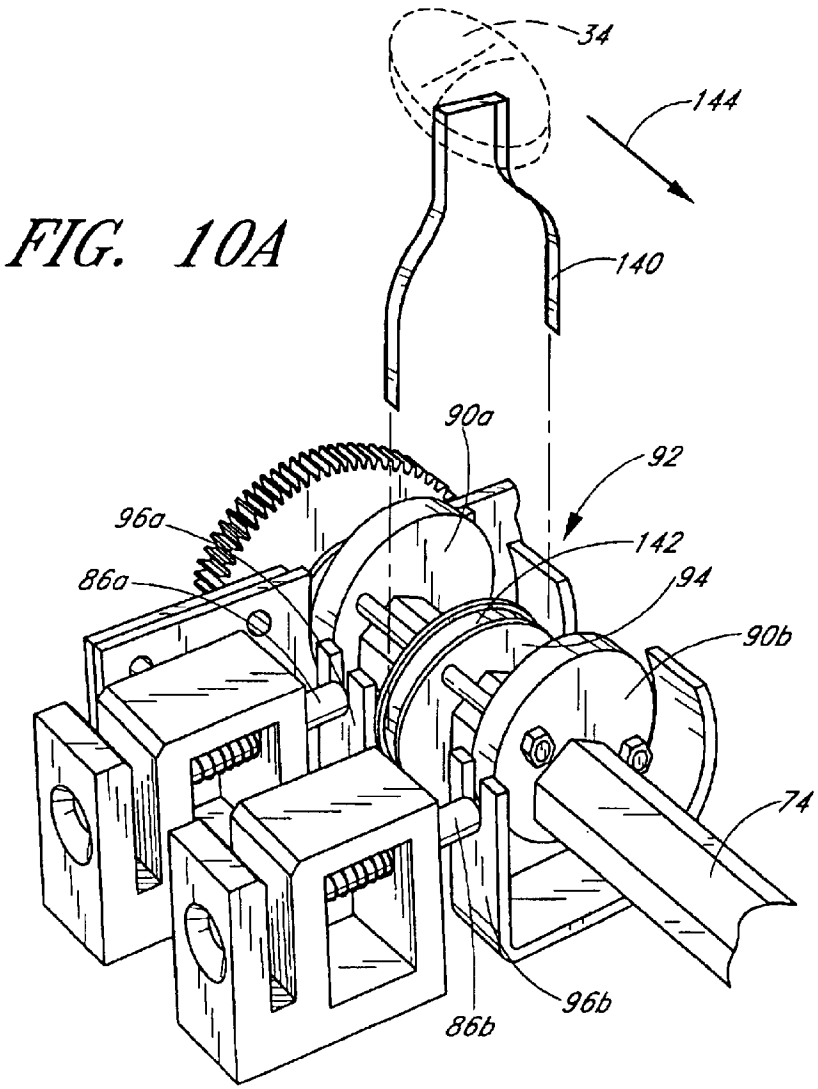
FIG. 10*a* is a partial isometric view of the slidable cam assembly removed from the automatic hole punch showing the actuation of the user interface for creating a first punching modality.

With reference to FIGS. 10*a* and 10*b*, the modality switch 34 is connected to a pair of legs 140 configured to reside within a channel 142 formed around the periphery of the actuator ring 94. As discussed above, the actuator ring 94 is coupled to the slidable cams 90*a*, 90*b*, by struts 95, the entire assembly comprising the slidable cam assembly 92. The user applied force to the modality switch 34 is translated through the legs 140 and to the actuator ring 94, which causes the slidable cam assembly 92 to linearly displace along the camshaft 74. FIG. 10*a* illustrates the slidable cam assembly 92 in a first position in which the slidable cam 90*b* is adjacent to, and in driving engagement with, its respective punch 86*b*. It can also be seen that slidable cam 90*a* is idle, meaning that it is not adjacent its respective punch 86*a* and therefore, will not drive the punch 86*a* during revolution of the camshaft 74.

When desiring to switch between punching modalities, a user applies a force to the modality switch 32, for example, in direction 144, which causes the slidable cam assembly 92 to translate along the camshaft 74 into a second position as illustrated in FIG. 10*b*. In this position, it can be seen that slidable cam 90*b* is idle with respect to its associated punch 86*b* while slidable cam 90*a* is adjacent to, and in driving engagement with, its respective punch 86*a*. When the automatic hole punch is actuated in this position, punch 86*a* will remain motionless, while punch 86*b* will be driven by its respective cam 90*b* through its punching die 102. Sliding the modality switch 34 in direction 146 will return the automatic hole punch to the initial punching mode. An "idle" cam is one that is not in driving engagement with an associated punch. For example, even though an idle cam is constrained to rotate with the camshaft 74, it is not positioned adjacent to, and in driving engagement with, an associated punch 86. Conversely, the cams 90 that are not idle, or in a "driving position," are adjacent to a punch and linearly drive the same when rotated with the camshaft 74.

In another embodiment, those of skill in the art will readily realize that it would be a simple task of configuring the punches 86 for lateral translation, alternatively or in addition to slidable cams 90*a, b*. For example, one or more punches 86 could be positionable, such as along a transverse rail, for selective positioning. The camshaft 74 can carry any of a number of cams 90 at predetermined locations along its length, and one or more punches 86 can be configured to selectively be positioned adjacent to any one, or none, of the cams 90. Accordingly, the punches 86 can be selectively positioned to result in an almost infinite number of punching modalities and/or hole spacings. For example, when switching between punching modalities, such as from three-hole to two-hole modes, two punches can be translated such that one punch moves from a first driving position to a second driving position, while a second punch moves from a first driving position to an idle position. Accordingly, one punch is repositioned, yet still in driving engagement with a cam, while the other punch moves from a driving position to an idle position. Therefore, the hole spacing is altered and one punch becomes idle, thereby resulting in fewer punches 86 being driven.

Moreover, while it is contemplated that a plurality of cams can be positioned along the camshaft at predetermined locations, it is also contemplated that the camshaft can be one continuous cam along its entire length. As such, a punch could conceivably be positioned anywhere in proximity to the camshaft and the camshaft profile will actively drive the punch. In this embodiment, the camshaft profile can have a constant cross section in the shape of a suitable cam. Alternatively, the camshaft profile can be one that presents a helical cam profile, such that any punches that are present will be driven sequentially, rather than simultaneously, thereby distributing the full punching force to each cam individually.

In conjunction with a slidable punch, a corresponding slidable die can be mounted to be likewise configurable. For example, the lower tray can carry a rail substantially parallel to the camshaft 74 on which the dies can slide. The rail can further have a plurality of notches configured at predetermined locations to securely hold a portion of each die. Furthermore, the dies can be biased toward the rail, such that as a die is slidably disposed along the rail, the die will resiliently fall into the next adjacent slot and be securely held thereby. A cam is located appropriately relative to each slot such that a die located at a given slot will position its corresponding punch at the proper location to be driven by the respective cam.

Working in conjunction with the user-actuatable modality switch 34 is the spacer 130 that is selectively positioned within the slot 38 formed in the upper housing unit 32 for receiving a material to be punched. In one embodiment, the two-hole punching mode should space the two holes a distance of about 72.95 mm (2⅞ inches) from the edges of the material, while the three-hole mode should space the first hole a distance of about 31.7 mm (1¼ inches) from the top of the material, with the remaining two holes following at about 108 mm (4¼ inch) intervals. However, in order to satisfy current hole punching standards, the punches 86 must be located differently with respect to the edge of the material for the two and three-hole modes. As discussed above in relation to one embodiment, in the three-hole mode, the first hole is created 1¼ inches from the top edge of the material, while in the two-hole mode, the first hole is created 72.95 mm (2⅞ inches) from the left edge of the paper. In switching between the two and three-hole modes, there is one punch that is commonly used in both modes. The common punch creates a hole located 140 mm (5½ inches) from the top of the material in the three-hole mode, while in the two-hole mode, the created hole must be located about 143 mm (5⅝ inches) from the edge of the material. Consequently, either the punch, or the material, must be offset by 32 mm (⅛ inches) when switching between the two punching modes.

Figure 11A:
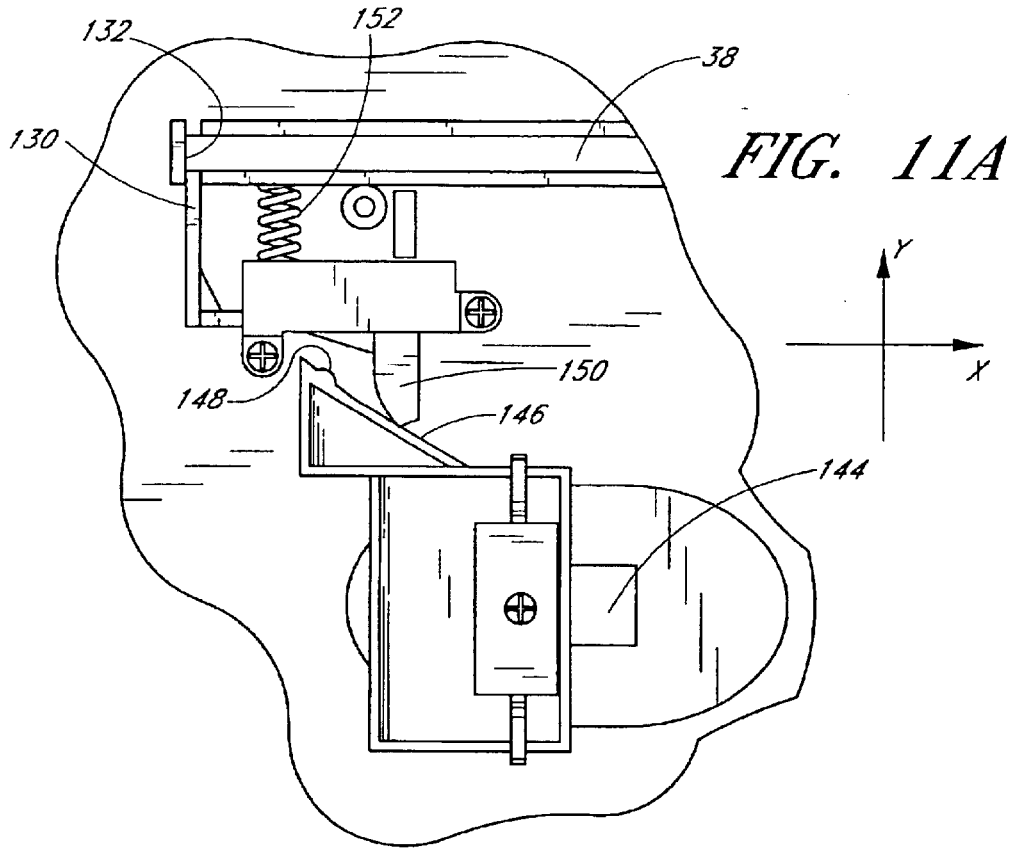
FIG. 11*a* is a partial bottom plan view of the upper housing unit showing the modality switch and spacer mechanism in a first punching modality.
Figure 11B:
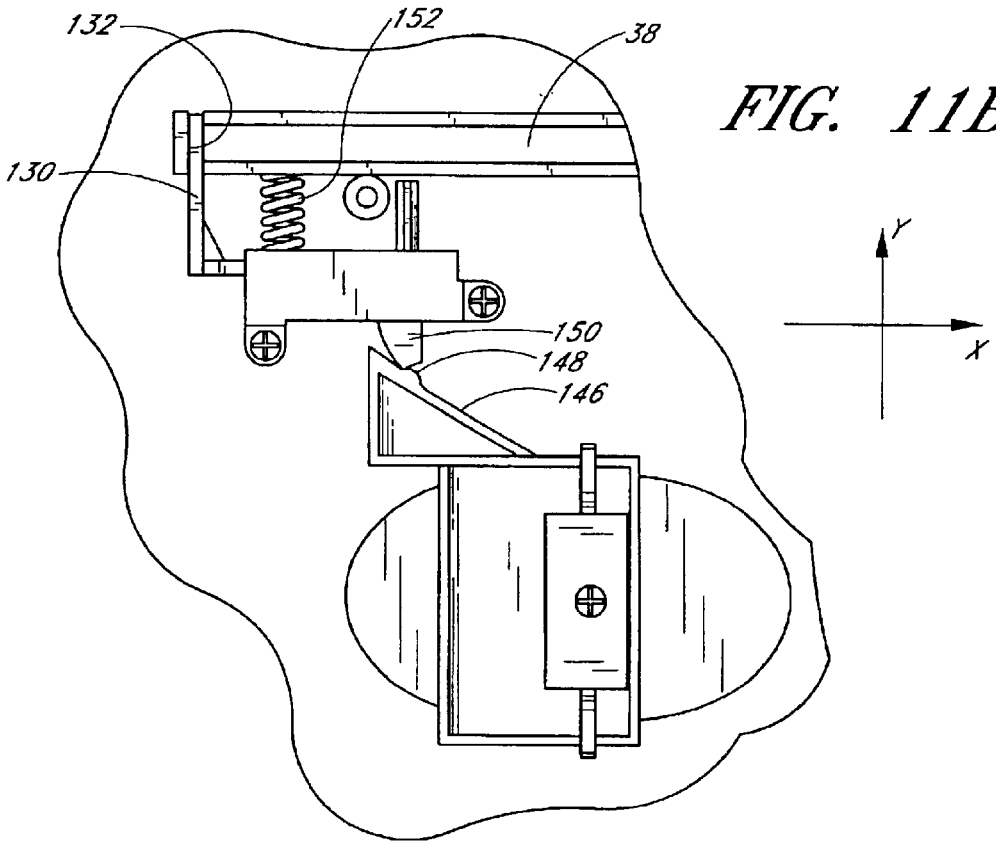
FIG. 11*b* is a partial bottom plan view of the upper housing unit showing the modality switch and spacer mechanism in a second punching modality.

To accomplish this, one embodiment incorporates a spacer 130 inserted into the slot 38 formed in the upper housing unit 32 to properly position the material to be punched depending on the selected punching mode. With reference to FIGS. 11*a* and 11*b*, the slot 38 is defined, in part, by a proximal edge 132 that serves to position the material with respect to the punches 86. In switching between punching modes, the spacer 130 is inserted into the slot 38 adjacent the proximal edge 132 such that material subsequently inserted into the slot 38 will be offset by an appropriate amount. In one embodiment, the spacer is about 31.75 mm (⅛ inch) wide and thus properly positions the paper with respect to the punches 86 based upon the selected punching mode. Of course, as an alternative to inserting a spacer, the punches 86 themselves can be reconfigured to appropriately locate the hole pattern along an edge of the material.

Notably, when discussing the differences between the various punching modes, such as two-hole, three-hole, and four-hole punching modes, it will be appreciated by one of skill in the art in light of the disclosure herein that a number associated with the mode, such as two, three, or four, does not necessarily refer to the number of punches being driven; but rather, refers to the number of holes created in a piece of material. For example, even when the automatic hole punch is configured in a two-hole mode, there may still be more than two punches being driven. However, there will only be two holes created in the material placed within the slot. In one embodiment, this is because the spacing between the proximal edge 132 of the slot 38 and the third punch is greater than the width of the paper. Thus, even though the third punch is driven by its respective cam, the material is not wide enough to extend from the proximal edge 132 of the slot to a location in front of the third cam to receive a hole therefrom. Accordingly, when referring to two-hole, three-hole, or other modalities, it refers to the number of holes typically created in a sheet of material, and not the number of cams or punches being driven.

The modality switch 34 slides within a groove 144 formed in the upper housing unit 32. Its travel limits are thus defined by the length of the groove 144. A ramp 146 is carried by the modality switch 34 and translates therewith and further has a stop 148 extending from the surface of the ramp 146. The spacer 130 carries a follower 150 configured to follow the slope of the ramp 146 as it is displaced along an x-axis. As the ramp 146 is displaced along an x-axis, the follower 150 and accompanying spacer 130 are displaced along a y-axis. Thus, sliding displacement of the modality switch 34 causes a perpendicular displacement of the spacer 130 which moves into and out of the slot 38.

A stop 148 is provided along the incline surface of the ramp 146 to maintain the follower 150 in its desired position relative to the ramp 146. A spring 152 provides a restoring force to the spacer 130 to withdraw the spacer 130 from the slot 38 once the ramp 146 disengages the follower 150. Therefore, the modality switch 38 is configured to not only displace the slidable cam assembly 92 between punching modalities, but to also simultaneously insert a spacer 130 into the slot 38 thereby properly positioning the material to be punched. Those of skill in the art will readily understand alternative structures that provide the benefits of the spacer 130 in light of the disclosure herein.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A hole punching apparatus comprising:

one or more punches, one or more punching dies, and one or more bores formed in the one or more punching dies for slidable insertion of the one or more punches;

a slot formed within the one or more punching dies configured to receive a material to be punched;

one or more cams coupled to a camshaft and configured to linearly drive the one or more punches through the one or more bores formed in the one or more punching dies and at least one slidable cam selectively positionable along the camshaft between a first position and a second position;

an electric motor configured to rotate the camshaft;

a housing configured to hold the one or more punches, one or more punching dies, one or more cams, and electric motor and further having a material slot formed in an upper surface configured to align a material to be punched relative to the one or more punches;

a modality switch moveable between a first mode position and a second mode position and further configured to move the at least one slidable cam between said first position and said second position and further configured to insert a spacer into the punching slot when in said second position.

2. The hole punching apparatus of claim 1, further comprising a reversing switch configured to reverse the direction of the motor upon activation.

3. The hole punching apparatus of claim 1, further comprising a cam switch having a switch arm carrying a cam follower configured to follow the cross section of the camshaft, the camshaft having a portion of its cross-section configured to allow the cam follower and accompanying switch arm to extend thereby disconnecting the cam switch.

4. The hole punching apparatus of claim 3, further comprising a capacitor for providing electrical current to the motor after the start switch has been disconnected.

5. The hole punching apparatus of claim 1, further comprising a slidable cam assembly having a first cam and a second cam spaced a fixed distance apart and slidable along the camshaft between a first position and a second position, and further having a first punch and a second punch wherein positioning the slidable cam assembly in the first position locates the first can adjacent the first punch in a punch driving position and positioning the slidable cam assembly in the second position locates the second cam adjacent the second punch in a punch driving position.

6. The hole punching apparatus of claim 1, further comprising one or more cam harnesses coupled to the one or more punches and configured to translate a withdrawing force from the one or more cams to the one or more punches.

7. A hole punching device comprising:

a plurality of punches;

a slot configured to align a material to punched;

at least one moveable cam coupled to and selectively positionable along a camshaft and configured for driving arrangement with at least one of the plurality of punches;

at least one static cam fixed along the camshaft and configured for driving arrangement with at least one of the plurality of punches;

a motor for rotating the camshaft so as to drive said punches; and a modality switch moveable between a first position and a second position for selecting between two or more punching modes and further configured to insert a spacer into the slot when in said second position.

8. The hole punching device of claim 7, further comprising a cam switch configured to automatically continue rotation of the camshaft for one complete revolution.

9. The hole punching device of claim 7, wherein said camshaft is operatively coupled to a motor by a gear train for transferring the output torque of the motor to the camshaft.

10. The hole punching device of claim 7, wherein each of said cams has a corresponding punch.

11. The hole punching device of claim 10, wherein the moveable cam is slideably disposed on said camshaft so as to be selectively engageable with its corresponding punch.

12. The hole punching device of claim 7, wherein one or more of the plurality of punches are selectively positionable to result in varying spacing between the plurality of punches.

13. The hole punching device of claim 7, wherein the two or more punching modes result in a plurality of holes having varying spacing therebetween.

14. The hole punching device of claim 7, wherein said punching modes include two-hole and three-hole punching modes.

15. The hole punching device of claim 7, wherein said motor sequentially drives said punches.

16. The hole punching device of claim 7, further comprising a reversing switch configured to reverse the operating direction of the motor.

17. A punch drive assembly for an automatic hole punching system, the punch drive assembly comprising:

a plurality of punches;

a slot configured to receive a material to be punched;

a camshaft;

at least one static cam in a fixed position on the camshaft;

a slideable cam assembly having at least two slideable cams that are selectively positionable along the camshaft, the slideable cam assembly moveable between a first position and a second position;

an electric motor configured to rotate the camshaft such that the at least one static cam and at least one slideable cam selectively engage the plurality of punches; and a switch moveable between a first mode position and a second mode position and further configured to move the slideable cam assembly between said first position and said second position, wherein said switch is further configured to insert a spacer into the slot when in said second mode position.

18. A hole punching apparatus comprising:

a plurality of punches;

a punching die having a plurality of bores, each bore corresponding to a different one of the plurality of punches;

a slot formed within the punching die, the slot configured to receive a material to be punched;

a plurality of cams coupled to a camshaft and configured to drive at least two of the plurality of punches, the plurality of cams comprising:

a moveable cam that is selectively positionable along the camshaft, the moveable cam being moveable between a first position and second position along the camshaft; and a static cam that is fixed along the camshaft;

an electric motor configured to rotate the camshaft;

a spacer configured to be selectively inserted into the slot; and a switch configured to insert the spacer into the slot when the moveable cam is in the second position.

* * * * *

UNITED STATES PATENT AND TRADEMARK OFFICE

CERTIFICATE OF CORRECTION

PATENT NO. : 6,983,877 B2
APPLICATION NO. : 10/353260
DATED : January 10, 2006
INVENTOR(S) : Joseph Y. Ko It is certified that error appears in the above-identified patent and that said Letters Patent is hereby corrected as shown below:

In Column 2, Line 18 (Approx.), delete “ridable” and insert -- slidable --

In Column 2, Line 26 (Approx.), delete “punching” and insert -- punches --

In Column 2, Line 36, after “reversing” delete “of”

In Column 2, Line 36, after “direction” insert -- of the --

In Column 3, Line 9, delete “two-holes,” and insert -- two-hole, --

In Column 4, Line 5, after “of the” insert --slidable --

In Column 15, Line 35 (Approx.), in Claim 5, delete “can” and insert --cam --

In Column 15, Line 46, in Claim 7, after “material to” insert --be --

Signed and Sealed this

Thirty-first Day of October, 2006

JON W. DUDAS
*Director of the United States Patent and Trademark Office*